US007320735B2

(12) United States Patent
Riske

(10) Patent No.: US 7,320,735 B2
(45) Date of Patent: Jan. 22, 2008

(54) FAN CLEANING METHOD AND APPARATUS

(75) Inventor: Stanley J. Riske, Hanover, MI (US)

(73) Assignee: Airmaster Fan Company, Jackson, MI (US)

( * ) Notice: Subject to any disclaimer, the term of this patent is extended or adjusted under 35 U.S.C. 154(b) by 282 days.

(21) Appl. No.: 11/093,394

(22) Filed: Mar. 30, 2005

(65) Prior Publication Data

US 2006/0218743 A1 Oct. 5, 2006

(51) Int. Cl.
*B08B 7/00* (2006.01)
*A47L 5/24* (2006.01)

(52) U.S. Cl. ..... 134/7; 134/21; 451/36; 451/38; 451/39; 15/346

(58) Field of Classification Search ..... None
See application file for complete search history.

(56) References Cited

U.S. PATENT DOCUMENTS

| | | | | | |
|---|---|---|---|---|---|
| 2,622,047 | A | * | 12/1952 | Ayers | 134/7 |
| 3,222,707 | A | * | 12/1965 | Allenbaugh | 15/345 |
| 4,249,281 | A | | 2/1981 | Meyer et al. | 15/340 |
| 4,458,375 | A | | 7/1984 | Killeen | 15/236 |
| 4,823,431 | A | | 4/1989 | Carpenter | 15/394 |
| 4,827,556 | A | | 5/1989 | Corsetti | 15/244.1 |
| 4,841,592 | A | | 6/1989 | Restivo | 15/210 |
| 4,865,401 | A | * | 9/1989 | Jacobson | 312/1 |
| 5,108,260 | A | | 4/1992 | Monrose, III et al. | 416/142 |
| 5,116,151 | A | | 5/1992 | Lytton et al. | 401/9 |
| 5,180,284 | A | | 1/1993 | Monrose, III et al. | 416/204 |
| 5,369,836 | A | | 12/1994 | Horne | 15/210.1 |
| 5,478,406 | A | * | 12/1995 | Derby et al. | 134/16 |
| 5,741,341 | A | | 4/1998 | Stanek | 55/356 |
| 5,765,259 | A | | 6/1998 | Cika | 15/394 |
| 5,795,131 | A | | 8/1998 | Crowhurst et al. | 416/146 |
| 5,934,869 | A | | 8/1999 | Janisse | 415/121.3 |
| 5,947,686 | A | | 9/1999 | Keyes | 416/61 |
| 6,098,245 | A | | 8/2000 | Satterfield et al. | 15/412 |
| 6,314,611 | B1 | | 11/2001 | Sauers | 15/376 |
| 6,345,409 | B1 | | 2/2002 | LaCroix | 15/394 |
| 6,719,531 | B2 | | 4/2004 | Wu | 416/206 |
| 6,782,579 | B1 | | 8/2004 | Grimm | 15/245 |
| 6,811,377 | B2 | | 11/2004 | Tang | 416/132 |

* cited by examiner

*Primary Examiner*—David Redding
(74) *Attorney, Agent, or Firm*—Gifford, Krass, Sprinkle, Anderson & Citkowski, PC

(57) ABSTRACT

A simple yet effective system for cleaning fans and air circulators facilitates the cleaning of ceiling and hard-to-reach units without having to remove the blades or other parts to be cleaned. A flexible bag encloses parts of a fan to be cleaned. A source of compressed air is used for inflating the bag, and a source of vacuum is used for collecting particulates used for cleaning. A user-controlled nozzle is used for spraying particulates against parts of the fan to be cleaned. The user-controlled nozzle terminates in a narrow tube operative to puncture the bag, which is preferably a transparent plastic bag. The source of compressed air and the source of vacuum may share a common vacuum unit with particulate filter such as a "shop-vac" type of equipment. The particulates used for cleaning may include any suitable abrasive though, in the preferred embodiment, granulated walnut or other nut shells are used. In contrast to devices that clean with liquids, the enclosure may envelope the motor and blades.

6 Claims, 1 Drawing Sheet

FAN CLEANING METHOD AND APPARATUS

FIELD OF THE INVENTION

This invention relates generally to fan cleaning and, in particular, to fan cleaning apparatus that isolates the person cleaning from particulates generated in the process.

BACKGROUND OF THE INVENTION

Fan blades require routine cleaning, particularly in industrial settings. However, some units are high off the ground, and some may be coated with unpleasant if not dangerous particulates.

To address this problem, U.S. Pat. No. 5,934,869 teaches a fan cleaning system for cleaning a fan having a guard enclosing a fan blade driven by a motor. The system comprises a shroud for enclosing the guard and the blade, the motor of the fan being mounted to the blade, but outside of said shroud, and at least one spray head within the shroud for cleaning the guard and the blade. Steam, hot water, soap and/other cleansers or solvents are supplied to the spray head by a supply line. Waste water is removed from the cleaning shroud via a drain in the bottom of the lower shroud. A pump unit removes water from the drain via a return line. The pump unit includes a filter leading to a recycling unit and return to the clean water reservoir where detergent is added. The water is then heated by a heat source and returned to the spray arm by the supply line.

Although such a system may be effective, it is complex, expensive, and subject to liquid leaks.

SUMMARY OF THE INVENTION

This invention resides in a simple yet effective system for cleaning fans and air circulators. In contrast to existing systems, the system facilitates the cleaning of ceiling and hard-to-reach units without having to remove the blades or other parts to be cleaned. The preferred embodiment includes a flexible bag for enclosing parts of a fan to be cleaned. A source of compressed air is used for inflating the bag, and a source of vacuum is used for collecting particulates used for cleaning. A user-controlled nozzle is used for spraying particulates against parts of the fan to be cleaned.

In the preferred embodiment as well, the user-controlled nozzle terminates in a narrow tube operative to puncture the bag, which is preferably a transparent plastic bag. The source of compressed air and the source of vacuum may share a common vacuum unit with particulate filter such as a "shop-vac" type of equipment. The particulates used for cleaning may include any suitable abrasive though, in the preferred embodiment granulated walnut or other nut shells are used.

DETAILED DESCRIPTION OF THE INVENTION

Figures 1, 2, 3:
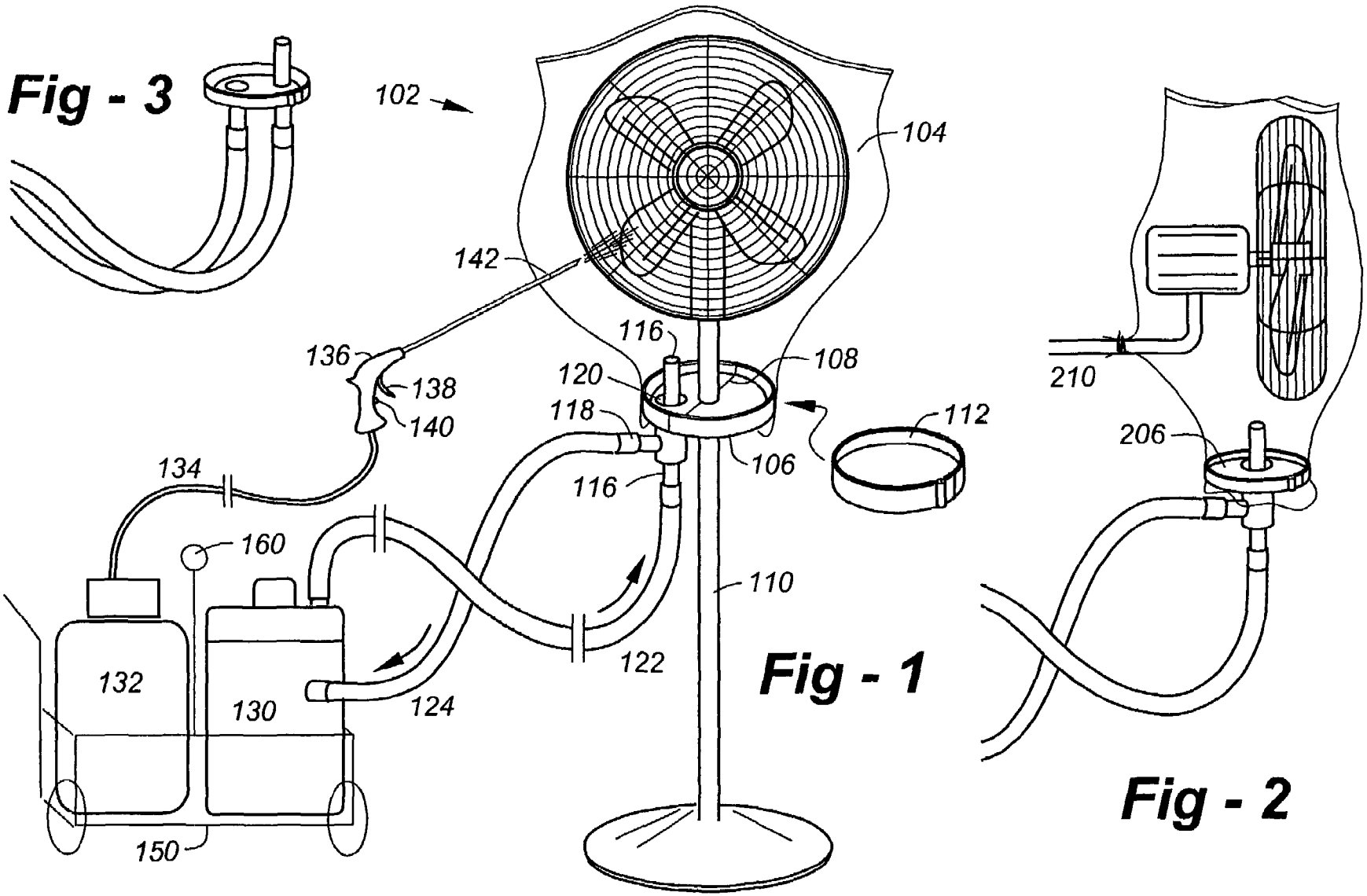
FIG. 1 is a drawing which depicts an embodiment of the invention suited to upright stand fans or air circulators.
FIG. 2 is a drawing which shows an alternative embodiment of the invention more suited to arm-supported fans or air circulators.
FIG. 3 is a drawing which illustrates how the pressurization and vacuum lines may alternatively be placed side by side.

Referring to FIG. 1, a first preferred embodiment of the invention is used to clean stand-supported fans, one of which is depicted generally at 102. The system includes a containment enclosure, preferably in the form of a transparent plastic bag 104 enabling a user to observe the progress of the cleaning operation. In contract to prior-art systems, the bag 104 may be placed over the entire fan assembly, including the motor.

The lower end of the bag 104 is gathered around a tray 106 and held thereagainst with an adjustable band 112. The tray 106 includes a split 108 enabling two half pieces to be placed on either side of the upright pole 110. The bore thorough the tray 106 may be provided in different sizes to suit different diameter poles 110. The tray may be constructed of any suitable material, such as metal or plastic.

Two pipes penetrate through the tray 106, including an air inlet 116 and an exhaust outlet 120. The air inlet 116 is connected to a source of compressed air through hose 122, and the exhaust is connected to a particulate trap through hose 124. A commercially available vacuum system 130 may be used, however, it is preferable to have at least slightly more air pressure than vacuum to ensure that the bag 104 is inflated around the fan to be cleaned.

Unit 132 is a source of abrasive particulates which are introduced through the bag 104 for cleaning purposes. Although sandblasting may be used, in the preferred embodiment ground walnut or other nut shells are used because they are less abrasive, biodegradable, and generally inexpensive. The particulates are preferably directed against the fan blades, shroud, and other parts to be cleaned through a narrow wand 142 connected to a handle 136. A trigger 138 on the handle controls the flow of blasting, with an optional button 140 being used to deliver forced air only to clean without particulate. Although the nozzle 142 may be used to puncture the bag 104 in various locations, the holes are small and may be taped over, if necessary. As such the bag 104 may be used again before discarding.

The units 130 and 132 are conveniently provided on a common cart 150, and may have provisions for lifting by a forklift or hoist (160) to reach high fan units. As such any or all of the hoses may be of sufficient length to reach ceiling installations. In operation, the bag 104 is inflated and the wand being used to puncture the bag and blast the components to be cleaned from different directions, as necessary. The particles used for cleaning are automatically drawn into the tray and collected in the vacuum chamber through hose 124. Depending upon how dirty and/or worn the particles are, they, too, may be reused before discarding.

FIG. 2 is a drawing which depicts an alternative embodiment of the invention more suited to arm-supported fans or air circulators. In this case the tray 206 may be smaller and need not be split to clamp onto the support 210. A suitable hole may be made in the bag to accommodate the support 210, with tape being used to seal any large voids. Although the pressurization and vacuum lines have been shown concentrically, they may alternatively be placed side by side, as shown in FIG. 3.

I claim:

1. A fan cleaning system, comprising:

a flexible bag for enclosing parts of a fan to be cleaned;

a source of compressed air for inflating the bag;

a container holding a supply of abrasive particulates;

a user-controlled nozzle for spraying the particulates against parts of the fan to be cleaned, the nozzle including a hand-held proximal portion with a flexible hose interconnected to the particulate container and a distal tube enabling a user to puncture the flexible bag to access the parts of the fan; and a source of vacuum for collecting particulates used for cleaning.

2. The system of claim 1, wherein the bag is a transparent plastic bag.

3. The system of claim 1, wherein the source of compressed air and the source of vacuum share a common vacuum unit with particulate filter.

4. The system of claim 1, wherein the particulates used for cleaning are granulated nut shells.

5. The system of claim 1, wherein the bag encloses the motor and blades of a fan.

6. A method of cleaning a fan, comprising the step of:

providing the system of claim 1;

puncturing the bag with the nozzle; and spraying particulates to the parts of the fan until acceptably clean.

* * * * *